United States Patent [19]

Bodsworth

[11] Patent Number: 4,469,511

[45] Date of Patent: Sep. 4, 1984

[54] REMOVING PHOSPHORUS FROM IRON

[75] Inventor: Colin Bodsworth, Slough, England

[73] Assignee: National Research Development Corporation, London, England

[21] Appl. No.: 534,716

[22] Filed: Sep. 22, 1983

[30] Foreign Application Priority Data

Sep. 23, 1982 [GB] United Kingdom ..... 8227177

[51] Int. Cl.[3] ..... C21C 7/00

[52] U.S. Cl. ..... 75/51; 75/49; 75/53; 75/58; 75/59

[58] Field of Search ..... 75/51, 53, 58, 49, 59

[56] References Cited

U.S. PATENT DOCUMENTS 3,980,469 9/1976 Forster ..... 75/49

4,212,665 7/1980 Barton ..... 75/49

*Primary Examiner*—Peter D. Rosenberg

*Attorney, Agent, or Firm*—Oblon, Fisher, Spivak, McClelland & Maier

[57] ABSTRACT

To remove phosphorus from iron to a desired level, a charge of the iron is melted in a vessel followed by either (i) supplying gas such as 40% $CO_2$+9% CO+51% $H_2$ to the charge before melting is complete, or (ii) adding, to the charge, iron which is partly or wholly oxidized equivalent to adding iron ore of up to 8% of the charge weight, or a combination of (i) and (ii), such as would at 1600° C. supply an oxygen partial pressure of at least $10^{-10}$ atmospheres. Then, when the surface of the charge is substantially molten but before the surface of the charge reaches 1550° C., either (a) slag is removed from the surface of the charge or (b) a refractory oxide compatible with the vessel lining is added sufficient to form a viscous slag or (c) (permissible only with a basic vessel lining) basic oxide(s) and optionally a flux are added to form a fluid slag.

12 Claims, No Drawings

REMOVING PHOSPHORUS FROM IRON

BACKGROUND OF THE INVENTION

Field of the Invention

This invention relates to a method of removing phosphorus from iron, usually in the course of steelmaking.

In the method according to the invention, phosphorus can be lowered to the level required in the steel which is being made by the time the charge is molten, and the charge need contain no excess carbon at this stage, whereby subsequent refining may be simplified. The iron which is the starting material in the present invention may be prepared partly or wholly from steel scrap, for example.

SUMMARY OF THE INVENTION

The present invention consists of a method of removing phosphorus from iron to a desired level, comprising melting a charge of the iron in a vessel; either (i) supplying gas to the charge before melting is complete, and preferably from as soon as it begins to melt or shortly thereafter, the gas being non-reactive or being of such a composition as would have at 1600° C. an oxygen partial pressure of at most $10^{-2}$ atmospheres, or (ii) adding, to the charge, iron which is partly or wholly oxidised equivalent to adding iron ore of up to 8% of the charge weight, or a combination of (i) and (ii), which shall in any case be equivalent to an oxygen partial pressure on the foregoing basis of at least $10^{-10}$ atmospheres; and then, when the surface of the charge is substantially molten but before the surface of the charge reaches 1550° C. (preferably before 1500° C.), either (a) removing slag from the surface of the charge or (b) adding a refractory oxide compatible with the vessel lining sufficient to form a viscous slag (the adding being permissible even before the surface of the charge is substantially molten) or (c) (permissible only with a basic vessel lining) adding basic oxide(s) such as lime and/or magnesia, and optionally a flux such as calcium fluoride to form a fluid slag.

SUMMARY OF THE PREFERRED EMBODIMENTS

The gas is preferably supplied by blowing it on to or into the bath with sufficient velocity to impart turbulence to the molten part of the charge, whereby to increase the rate of phosphorus removal to the slag relative to the rate with a static (non-turbulent) bath.

The notional 1600° C. partial pressure of the oxygen supplied by gas and/or iron oxide is preferably equivalent to at least $10^{-9}$ atmospheres. As a guide, a gas consisting of volume of 51% hydrogen, 44% carbon monoxide and 5% carbon dioxide would count as $2\times10^{-9}$ atmospheres on this basis, and a gas consisting of 51% hydrogen, 34% carbon monoxide and 15% carbon dioxide would count as $3\times10^{-8}$ atmospheres on this basis. The supplied gas may comprise the product of partial combustion of hydrocarbon.

The notional 1600° C. partial pressure of oxygen is preferably at most $10^{-7}$ atmospheres, more preferably at most $10^{-8}$ atmospheres. The vessel lining is more susceptible to attack at high oxygen concentrations. Phosphorus would certainly be removed at higher oxygen concentrations but it is a feature of this preferred mode of operating the invention that just sufficient oxygen is supplied, and at a controlled rate (generally approximately equal to its rate of consumption by oxidation of metalloids), to facilitate phosphorus removal without excessive attack on the vessel lining during the period when the charge is melting.

The maximum partial pressure of oxygen which can be incorporated in the gas without undue damage to the refractory lining is also dependent on the rate at which oxygen is supplied (by the gas plus the melting iron oxide) as a proportion of the rate at which it is consumed by oxidation of carbon, phosphorus, etc. For a given mass of charge, the maximum permissible partial pressure of oxygen is thus preferably decreased as the rate of oxygen supply is increased (from the gas and/or iron oxide).

The iron oxide (the partly or wholly oxidised iron) may be for example iron ore or partially reduced sponge iron, a sample of 5% of the charge weight of 60%-reduced sponge iron being thus equivalent to 3% of the charge weight of iron ore.

For a charge containing, for example, up to 0.05% phosphorus where the specification for the resulting steel is maximum 0.015% phosphorus, or for a charge containing up to 0.08% phosphorus—steel specification maximum 0.025% phosphorus, a preferred combination of gas (i) and ore equivalent (ii) would be gas with an oxygen partial pressure on the foregoing basis of $10^{-9}$ atmospheres plus 3% iron ore equivalent. Here, the gas will be slightly reducing to the charge at 1600° C. but in cooperation with the sponge iron will supply just enough oxygen to form just enough self-generated slag to mop up the phosphorus. Where the iron which contains the phosphorus contains exceptionally high carbon (e.g. 4%) or much silicon (e.g. 1%), these will compete for the oxygen, which should then be increased somewhat to compensate. Likewise, the oxygen should be increased if very low levels of phosphorus are required. More generally, hydrogen/carbon monoxide/carbon dioxide mixtures containing 5–40 volume % of carbon dioxide (or mixtures with an equivalent oxygen potential at 1600° C.) in conjunction with partially reduced iron ore equivalent to an iron ore addition of $1\frac{1}{2}$–8% of the charge weight have been successful.

The slag (a) is in practice an insignificant proportion of the charge, typically about 3% by weight; in prior processes, a proportion of over 10% by weight was not unusual.

The viscous slag (option (b)) is intended to retard phosphorus reversion to the charge and, with an acid-lined vessel, may be produced by adding an acidic refractory oxide such as alumina. With a basic vessel lining, a basic refractory oxide may be added to produce the slag, such as lime or dolomite ($CaO+MgO$). It may be added as early as desired, even to the cold charge.

The fluid slag (option (c)) preferably has a basicity (defined as mole ratio $CaO/SiO_2$) of from 1.5 to 4, and is intended to stabilise the phosphorus in the slag.

Unless it is possible to remove the slag (a) speedily, it is preferable deliberately to form a slag (b) or (c), which allows the charge to be kept molten for at least an hour without undue phosphorus reversion. This may be desirable in order to heat the charge sufficiently to pour it, or to refine or reduce it or to perform other manipulations on it.

It will be appreciated that the partial pressure of oxygen, which has to be present according to the invention, has the effect of reacting with the phosphorus, and the resulting phosphorus-oxygen compounds form the slag (a), which may then be absorbed into the slag (b) or (c). Since, with phosphorus, reversion from the slag into the charge can occur, the self-generated slag (a) is removed quickly, or the slag (b) is made viscous, physically hindering reversion, or the slag (c) is alkaline, thermodynamically stabilising the phosphorus against reversion.

The partial pressure of oxygen may be as oxidised iron or oxidised hydrocarbon (i.e. carbon dioxide or water vapour).

The invention will now be described by way of example.

EXAMPLE 1

A 1 kilogram steel charge was induction heated in an alumina crucible to 1700° C. The charge was heated under an inert atmosphere until the charge surface temperature reached 1200° C. An oxidising blow gas comprising 40.0% $CO_2$, 8.8% CO, 51.2% $H_2$ by volume was then fed at a rate of 60 liters per hour (all gas compositions and flow rates were measured at room temperature at the gas inlet). The bath was judged to be fully molten after heating for 75 minutes and was held at an average temperature of 1690° C. under the oxidising blow gas for 16 minutes before cooling under nitrogen.

Chemical analysis of metal samples gave the following results:

| | % C | % S | % P | % Mn | % Si |
|---|---|---|---|---|---|
| Charge | 0.55 | 0.059 | 0.078 | 0.98 | 0.075 |
| At clear melt | 0.10 | ND | 0.005 | 0.96 | ND |
| Ingot | 0.081 | ND | 0.003 | 0.74 | ND |

(ND = not determined)

The phosphorus content of the metal increased after melting was completed, rising to 0.010% at 5 minutes and to 0.041% at 12 minutes after clear melt. Thereafter the concentration decreased rapidly to the level found in the solidified ingot.

After the solidified metal was removed, the crucible showed a dark brown zone on the inner surface in the vicinity of the gas-melt interface, but there was little evidence of erosion of the surface in this zone.

Only a very thin layer of slag was found on the ingot top. The estimated slag weight, based on a materials and oxygen balance, was 25–30 grams. In a 'production' run, the (self-generated) slag would have been removed from the surface of the charge immediately, before clear melt.

EXAMPLE 2

A charge comprising 949 grams of metal and 51 grams of direct reduced iron (69.6% reduced) was heated in an alumina crucible. The charge was heated initially under a nitrogen atmosphere. This was replaced, when the charge surface temperature reached 1360° C., by a mixture of 15% $CO_2$, 33.8% CO and 51.2% $H_2$ by volume (measured at room temperature), blown at 60 liters per hour. Melting was completed in 90 minutes and the charge was held molten at an average temperature of 1660° C. for a further 60 minutes. The metal analyses were as follows:

| | % C | % S | % P | % Mn | % Si |
|---|---|---|---|---|---|
| Charge | 0.41 | 0.050 | 0.050 | 1.00 | 0.050 |
| At clear melt | 0.15 | ND | 0.009 | 0.48 | ND |

-continued

| | % C | % S | % P | % Mn | % Si |
|---|---|---|---|---|---|
| Ingot | 0.040 | ND | 0.009 | 0.22 | ND |

The maximum metal phosphorus content recorded between clear melt and the end of the experiment was 0.013%.

The used crucible showed a zone of black discolouration at the position of the melt-air interface, extending 1 or 2 mm into the crucible wall, but there was no indication of erosion of the surface. The estimated slag weight was approximately 35 grams. In a 'production' run, the (self-generated) slag would have been removed from the surface of the charge immediately, before clear melt.

EXAMPLE 3

980 grams of metal and 24.5 grams of high grade hematite iron ore were heated in an alumina crucible. Melting was completed in 90 minutes and the bath was held at an average temperature of 1650° C. for 90 minutes. A nitrogen atmosphere was used, up to a charge surface temperature of 1400° C. A gas mixture of composition 15% $CO_2$, 33.8% CO, 51.2% $H_2$ by volume (measured at room temperature) was then blown on to the charge at a rate of 60 liters per hour and this was continued to the end of the experiment.

The metal compositions analysed as follows:

| | % C | % S | % P | % Mn | % Si |
|---|---|---|---|---|---|
| Charge | 0.40 | 0.057 | 0.076 | 1.00 | 0.049 |
| At clear melt | 0.20 | ND | 0.022 | 0.46 | ND |
| Ingot | 0.024 | ND | 0.036 | 0.18 | ND |

The analysed metal phosphorus content was 0.021% five minutes after the clear melt stage, but showed progressive increase with time thereafter.

The crucible showed slight erosion at the level of the melt-gas interface and a black layer in this zone, about 1 mm thick. Behind this, a brown discolouration extended to about one third of the thickness of the crucible wall. The estimated slag weight was 35–40 grams. In a 'production' run, the (self-generated) slag would have been removed from the surface of the charge immediately, before clear melt.

EXAMPLE 4

940 grams of metal and 50 grams of direct reduced iron (62.3% reduced) were heated, initially under an inert atmosphere, and held at 1650° C. for 15 minutes. A gas mixture of 20% $CO_2$, 28.8% CO, 51.2% $H_2$ by volume (measured at room temperature) was applied after the charge surface temperature had reached 1320° C., at a rate of 60 liters per hour.

The final metal analyses where:

| | % C | % S | % P | % Mn | % Si |
|---|---|---|---|---|---|
| Charge | 0.43 | 0.065 | 0.079 | 1.01 | 0.054 |
| At clear melt | 0.20 | ND | 0.021 | 0.56 | ND |
| Ingot | 0.114 | ND | 0.011 | 0.41 | ND |

No reversion of phosphorus from slag to metal occurred during the short hold time in the fully molten condition.

The crucible showd negligible erosion at the melt-gas interface and the discolouration in this zone extended 1-2 mm from the hot face. The estimated slag weight was 25-30 grams. In a 'production' run, the (self-generated) slag would have been removed from the surface of the charge immediately, before clear melt.

EXAMPLE 5

937 grams of metal and 63.5 grams of direct reduced iron were heated in a alumina crucible, under an inert atmosphere initially. A gas mixture containing 15% $CO_2$, 33.8% CO and 51.2% $H_2$ was applied from when the charge surface temperature was 1260° C. Melting was completed in 85 minutes. Two grams of lime were added 5 minutes after the clear melt and the melt was held at an average temperature of 1650° C. for a further 70 minutes. This example is not according to the invention, because lime should only be added to a furnace having a basic lining, but is included to demonstrate a point about the phosphorus.

The analysed metal compositions were:

| | % C | % S | % P | % Mn | % Si |
|---|---|---|---|---|---|
| Charge | 0.43 | 0.075 | 0.075 | 1.00 | 0.048 |
| At clear melt | 0.22 | ND | 0.018 | 0.42 | ND |
| Ingot | 0.050 | ND | 0.005 | 0.12 | ND |

The metal phosphorus content continued to fall after the clear melt, decreasing to 0.012% five minutes after the lime was added. Over the next 25 minutes the concentration increased again to 0.016% and then fell continuously to the end of the experiment. The phosphorus cannot be held in any mechanical way in the refractory, since this is of alumina. This therefore demonstrates that the present slag and gas conditions are appropriate in themselves for phosphorus removal. The estimated slag weight was 40-45 grams, and the molar ratio $CaO:SiO_2$ in the slag was 1.2:1.

EXAMPLE 6

950 grams of metal and 47.4 grams of direct reduced iron (62.3% reduced) was heated in an alumina crucible under an inert atmosphere. A gas mixture containing 20% $CO_2$, 28.8% CO and 51.2% $H_2$ and blown at a rate of 60 liters per hour was applied when the charge surface temperature reached 1400° C. Melting was completed in 78 minutes. Seven minutes later, 75 grams of pure alumina powder were added and the charge was held molten at an average temperature of 1700° C. for a further 75 minutes.

The metal analyses were:

| | % C | % S | % P | % Mn | % Si |
|---|---|---|---|---|---|
| Charge | 0.45 | 0.076 | 0.079 | 0.99 | 0.057 |
| At clear melt | 0.32 | ND | 0.025 | 0.80 | ND |
| Ingot | 0.030 | ND | 0.019 | 0.155 | ND |

The metal phosphorus content continued to fall after the alumina was added, reaching a minimum level of 0.011% 25 minutes after the addition was made, followed by a slow rate of increase with time.

Most of the alumina was recovered in lump form from the top of the solidified melt and it is estimated that only about 25 grams had dissolved in the slag. The crucible showed no evidence of erosion and only slight discolouration.

EXAMPLE 7

505 grams of metal, 180 grams of ferrochromium and 40 grams of direct reduced iron (55% reduced) was heated in a magnesia crucible. Melting was completed in 70 minutes and the charge was held at an average temperature of 1575° C. for 30 minutes. The charge was heated initially under a nitrogen atmosphere. A gas mixture comprising 24% $CO_2$, 76% $H_2$ by volume (measured at room temperature) was blown on to the charge at a rate of 60 liters per hour when melting was nearing completion. After 15 minutes, the gas composition was changed to 12% $CO_2$, 88% $H_2$ and this was maintained until the refining was halted. No slag forming additions were made either to the charge or to the melt.

The metal analyses were:

| | % C | % P | % Mn | % Si | % Cr |
|---|---|---|---|---|---|
| Charge | 0.40 | 0.037 | 0.086 | 0.388 | 17.89 |
| At clear melt | 0.26 | 0.012 | ND | ND | 17.88 |
| Ingot | 0.18 | 0.021 | ND | ND | ND |

When the gas composition was changed from 24% to 12% $CO_2$ the metal analysed 0.014% P, 17.92% Cr (exceeds the original because of analytical uncertainty and/or because iron has oxidised away). The crucible showed discolouration over the entire surface below the melt level, but the maximum penetration was not more than one millimeter at any point over this area.

In practice, one would continue to refine to whatever lower carbon content is required.

EXAMPLE 8

655 grams of austenitic stainless steel scrap and 40 grams of direct reduced iron (55% reduced) was heated in a magnesia crucible, initially under an inert atmosphere, and was held at 1540° C. for 30 minutes. As in the previous example, a gas mixture of 24% $CO_2$, 76% $H_2$ by volume was applied at a rate of 60 liters per hour when melting was nearing completion and, after 15 minutes, the composition was changed to 12% $CO_2$, 88% $H_2$. No slag forming additions were made.

The analysed metal compositions were:

| | % C | % P | % Mn | % Si | % Cr | % Ni |
|---|---|---|---|---|---|---|
| Charge (nominal composition) | 0.076 | 0.036 | 1.47 | 0.033 | 17.35 | 8.19 |
| At clear melt | 0.020 | 0.000 | ND | ND | 17.50 | ND |
| Ingot | 0.015 | 0.006 | ND | ND | 17.26 | ND |

The crucible showed slight discolouration, but negligible attack at the slag line.

With adequate control of the rate of oxygen supply to the bath, the method can be operated to remove phosphorus to a low level whilst retaining a high proportion of oxidisable alloy elements in the metal. Thus, if the slag is removed at clear melt especially in Examples 1, 6, 7 and 8, even if the (expensive) oxidisable alloy elements (principally manganese and chromium) are oxidised in subsequent refining, they can be reduced back into the metal without risk of phosphorus revision.

I claim:

1. A method of removing phosphorus from iron to a desired level, consisting essentially of:

(I) resulting a charge of said iron;

(II) contacting said iron with an oxygen-containing substance having a partial pressure of oxygen at 1600° C. equivalent at least $10^{-10}$ atm to form a slag comprising phosphorus and/or oxygen-containing compounds by:

(i) supplying a gas to the charge before melting is completed; said gas selected from non-reacting gas, a gas having a partial pressure of oxygen at 1600° C. of at most $10^{-2}$ atm, and mixtures thereof; and/or (ii) admixing said charge with an oxydized iron material in an amount equivalent to up to 8% of iron ore of the charge weight; and then (iii) separating said phosphorus and/or oxygen containing compounds by:

(a) removing said slag from the surface of the partially molten charge before the temperature of said surface reaches 1550° C.; or (b) admixing said slag with a refractory oxide to form a viscous slag, or with a basic oxide to form a fluid slag.

2. The method according to claim 1, wherein the partial pressure of oxygen of the oxygen-containing substance added in step (II) is equivalent to at least $10^{-9}$ atmopheres at 1600° C.

3. The method according to claim 2, wherein the partial pressure of said oxygen-containing substance added in step (II) is at most $10^{-7}$ atmospheres.

4. The method according to claim 1 wherein the oxidised iron material is iron ore or partially reduced sponge iron.

5. The method according to claim 1 wherein in step (II) a hydrogen/carbon monoxide/carbon dioxide mixture containing 5–40 volume percent of carbon dioxide or a mixture with an equivalent oxygen potential at 1600° C. is used in conjunction with partially reduced iron ore being equivalent in terms of oxygen to an iron ore addition of 1½–8% of the charge weight.

6. The method according to claim 1, wherein the fluid slag of step (III) (b) has a basicity of from 1.5 to 4.

7. The method according to claim 1 wherein the gas of step (II) (I) is supplied at the start of Step (I) or shortly thereafter.

8. The method according to claim 1, wherein the step selected from steps (II) (a) or (b) is performed before the surface of the charge reaches 1500° C.

9. The method of claim 1, wherein the basic oxide added in Step (III) (b) is selected from the group consisting of MgO, CaO, and a mixture thereof.

10. The method of claim 1, wherein the fluid slag of Step (III) (b) further comprises a flux.

11. The method of claim 10 wherein the flux is calcium fluoride.

12. The method of claim 1, wherein the gas of Step (II) (i) is supplied by blowing, thereby imparting turbulence to the molten charge.

* * * * *